US009505237B2

(12) United States Patent
Zengo et al.

(10) Patent No.: US 9,505,237 B2
(45) Date of Patent: Nov. 29, 2016

(54) DRYING DEVICE AND IMAGE FORMING APPARATUS

(71) Applicant: FUJI XEROX CO., LTD., Tokyo (JP)

(72) Inventors: Takeshi Zengo, Kanagawa (JP); Akira Sakamoto, Kanagawa (JP); Naoki Morita, Kanagawa (JP); Takuma Ishihara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/609,477

(22) Filed: Jan. 30, 2015

(65) Prior Publication Data

US 2016/0082748 A1 Mar. 24, 2016

(30) Foreign Application Priority Data

Sep. 24, 2014 (JP) ..... 2014-194363

(51) Int. Cl.
*B41J 11/00* (2006.01)

(52) U.S. Cl.
CPC ..... *B41J 11/002* (2013.01)

(58) Field of Classification Search
CPC .. B41J 11/002; G02B 1/12; G02F 1/133711; G02F 1/133734; G02F 1/133753; G02F 1/133788
See application file for complete search history.

(56) References Cited

U.S. PATENT DOCUMENTS

2005/0012778 A1* 1/2005 Nishino ..... B41J 11/002 347/29
2006/0050122 A1* 3/2006 Nakano ..... B41J 11/002 347/102
2006/0209150 A1* 9/2006 Iwata ..... B41J 3/407 347/102
2009/0033696 A1* 2/2009 Hama ..... B41J 29/393 347/9
2009/0225143 A1* 9/2009 Fukui ..... B41J 2/14233 347/102
2010/0073410 A1* 3/2010 Yui ..... B41J 2/0057 347/6

FOREIGN PATENT DOCUMENTS

JP 2013-256260 12/2013

OTHER PUBLICATIONS

Abstract and machine translation of JP 2013-256260.

* cited by examiner

*Primary Examiner* — Matthew Luu
*Assistant Examiner* — Patrick King
(74) *Attorney, Agent, or Firm* — Fildes & Outland, P.C.

(57) ABSTRACT

There is provided a drying device. A controller is configured to control a laser intensity so that the laser intensity becomes lower than a drying intensity set as an intensity for drying a liquid droplet when a printing part printed in advance on a recording medium is included in an illumination range of a laser element on an image formation surface of the recording medium, the laser element configured to illuminate laser to the liquid droplet ejected on the image formation surface of the recording medium in accordance with an image.

7 Claims, 18 Drawing Sheets

FIG. 7

118

| | INK DROPLET SIZE | | | |
|---|---|---|---|---|
| | NO | SMALL DROPLET | MIDDLE DROPLET | LARGE DROPLET |
| BLACK | ZERO (0) | SMALL (1) | MIDDLE (2) | LARGE (3) |
| MAGENTA | ZERO (0) | SMALL (1) | MIDDLE (2) | LARGE (3) |
| CYAN | ZERO (0) | SMALL (1) | MIDDLE (2) | LARGE (3) |
| YELLOW | ZERO (0) | SMALL (1) | MIDDLE (2) | LARGE (3) |

FIG. 10

141

| | IMAGE DENSITY (8 bit) | | | |
|---|---|---|---|---|
| LOWER LIMIT | 224 | 192 | 64 | 0 |
| UPPER LIMIT | 255 | 223 | 191 | 63 |
| BLACK | ZERO (0) | SMALL (1) | MIDDLE (2) | LARGE (3) |
| MAGENTA | ZERO (0) | ZERO (0) | SMALL (1) | MIDDLE (2) |
| CYAN | ZERO (0) | ZERO (0) | SMALL (1) | MIDDLE (2) |
| YELLOW | ZERO (0) | ZERO (0) | ZERO (0) | SMALL (1) |

FIG. 12

| | INK DROPLET SIZE | | | |
|---|---|---|---|---|
| | NO | SMALL DROPLET | MIDDLE DROPLET | LARGE DROPLET |
| BLACK | ZERO (0) | SMALL (1) | MIDDLE (2) | LARGE (3) |
| MAGENTA | ZERO (0) | SMALL (1) | MIDDLE (2) | LARGE (3) |
| CYAN | ZERO (0) | SMALL (1) | MIDDLE (2) | LARGE (3) |
| YELLOW | ZERO (0) | SMALL (1) | MIDDLE (2) | LARGE (3) |

150

[J/cm$^2$]

DRYING DEVICE AND IMAGE FORMING APPARATUS

CROSS-REFERENCE TO RELATED APPLICATIONS

This application is based on and claims priority under 35 U.S.C. §119 from Japanese Patent Application No. 2014-194363 filed on Sep. 24, 2014.

TECHNICAL FIELD

The present invention relates to a drying device and an image forming apparatus.

SUMMARY

According to an aspect of the exemplary embodiments of the present invention, there is provided a drying device comprising: a controller configured to control a laser intensity so that the laser intensity becomes lower than a drying intensity set as an intensity for drying a liquid droplet when a printing part printed in advance on a recording medium is included in an illumination range of a laser element on an image formation surface of the recording medium, the laser element configured to illuminate laser to the liquid droplet ejected on the image formation surface of the recording medium in accordance with an image.

BRIEF DESCRIPTION OF THE DRAWINGS

Exemplary embodiments of the present invention will be described in detailed based on the following figures, wherein:

FIG. 7 shows an example of a user image laser absorption index conversion table;

FIG. 10 shows an example of a recording medium laser absorption index conversion table;

FIG. 12 shows an example of a laser illumination intensity conversion table;

DETAILED DESCRIPTION

Figure 1:
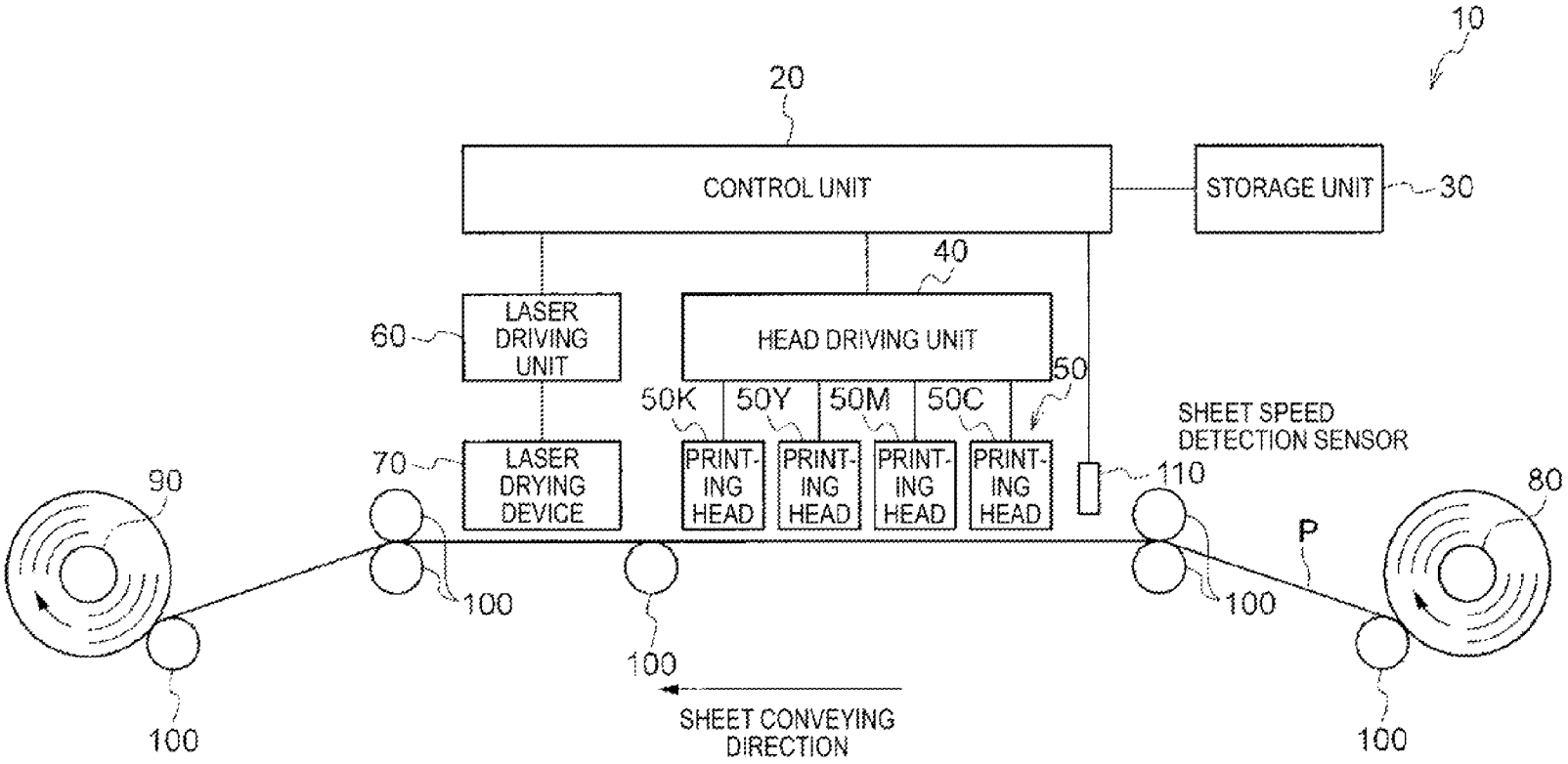
FIG. 1 is a schematic configuration view illustrating an example of main constitutional parts of an inkjet recording apparatus.

Hereinafter, illustrative embodiments of the present invention will be described with reference to the drawings. Meanwhile, the constitutional elements and processing having the same operational functions are denoted with the same reference numerals in the drawings, and the overlapping descriptions thereof may be appropriately omitted.

(First Illustrative Embodiment)

FIG. 1 is a schematic configuration view illustrating an example of main constitutional parts of an inkjet recording apparatus 10 according to this illustrative embodiment.

The inkjet recording apparatus 10 includes, a control unit 20, a storage unit 30, a head driving unit 40, a printing head 50, a laser driving unit 60, a laser drying device 70, a feeder roll 80, a discharge roll 90, conveyance rollers 100 and a sheet speed detection sensor 110, for example.

The control unit 20 is configured to drive a sheet conveying motor (not shown) to control rotations of the conveyance rollers 100 coupled to the sheet conveying motor through a mechanism such as gears, for example. The feeder roll 80 is wound thereon with a continuous sheet P, which is an example of the recording medium and is long in a sheet conveying direction. As the conveyance rollers 100 are rotated, the continuous sheet P is conveyed in the sheet conveying direction.

The control unit 20 is also configured to acquire image information, which is stored in the storage unit 30 and is to be printed on the continuous sheet P by a user, i.e., user image information and to control the head driving unit 40 on the basis of color information for each pixel of an image included in the user image information. The head driving unit 40 is configured to drive the printing head 50 coupled to the head driving unit 40 in accordance with ejection timing of ink droplets instructed from the control unit 20, to eject ink droplets from the printing head 50 and to form an image corresponding to the user image information on the continuous sheet P being conveyed. Hereinafter, the image that is formed on the continuous sheet P in accordance with the user image information is referred to as user image.

In the meantime, the color information for each pixel of the user image information includes information uniquely indicating a color of a pixel. In this illustrative embodiment, the color information for each pixel of a user image is expressed by a density of each of yellow (Y), magenta (M), cyan (C) and black (B), for example. However, the other expression methods of uniquely indicating a color of a user image may also be used.

The printing head 50 includes four printing head 50Y, 50M, 50C, 50K corresponding to four colors of yellow (Y), magenta (M), cyan (C) and black (B), respectively, and the ink droplets of corresponding colors are ejected from ink ejection ports provided for the printing head 50 of each color. In the meantime, a driving method for ejecting the ink droplets from the printing head 50 is not particularly limited, and a well-known method such as a so-called thermal method, a piezoelectric method and the like is used.

The laser driving unit 60 includes a switching element such as a FET (Field Effect Transistor) for controlling on and off of a laser element included in the laser drying device 70. The laser driving unit 60 is configured to drive the switching element on the basis of an instruction from the control unit 20, thereby controlling a duty ratio of pulses to adjust an illumination intensity of laser illuminated from the laser element. Specifically, as the duty ratio of pulses decreases, the laser illumination intensity is weakened, and as the duty ratio of pulses increases, the laser illumination intensity is strengthened.

The control unit 20 is configured to control the laser driving unit 60, thereby illuminating the laser from the laser drying device 70 towards an image formation surface of the continuous sheet P to dry ink droplets of the user image formed on the continuous sheet P and to thus fix the user image on the continuous sheet P.

Thereafter, the continuous sheet P is conveyed to the discharge roll 90 and is wound on the discharge roll 90 as the conveyance rollers 100 are rotated.

The sheet speed detection sensor 110 is disposed at a position at which it faces the image formation surface of the continuous sheet P, for example, and is configured to detect a conveying speed of the continuous sheet P in the sheet conveying direction. The control unit 20 is configured to calculate timing at which the ink droplets ejected from the printing head 50 to the continuous sheet P are conveyed into a laser illumination range of the laser drying device 70, on the basis of the conveying speed notified from the sheet speed detection sensor 110 and a distance from the printing head 50 to the laser drying device 70. The control unit 20 is configured to control the laser driving unit 60 so that the laser is illuminated from the laser drying device 70 to the ink droplets at the timing at which the ink droplets on the continuous sheet P are conveyed into the laser illumination range of the laser drying device 70.

In the meantime, a method for detecting the conveying speed of the continuous sheet P in the sheet speed detection sensor 110 is not particularly limited, and a well-known method is applied. Also, the sheet speed detection sensor 110 is not a member that should be necessarily provided for the inkjet recording apparatus 10 of this illustrative embodiment. For example, when the conveying speed of the continuous sheet P has been determined in advance, the sheet speed detection sensor 110 may not be provided.

Also, the ink includes oil-based ink from which solvent is evaporated, ultraviolet cure ink and the like. In this illustrative embodiment, however, aqueous ink is used. In this illustrative embodiment, when simply describing 'ink' or 'ink droplet', it means 'aqueous ink' or 'aqueous ink droplet'. Also, an IR (infrared) absorption agent is added to the respective inks of YMCK of this illustrative embodiment, so that a laser absorption degree of the ink is adjusted. However, it is not necessarily required to add the IR absorption agent to the respective inks of YMCK.

The inkjet recording apparatus 10 includes the laser drying device 70 configured to dry the ink droplets ejected to the continuous sheet P.

Figure 2:
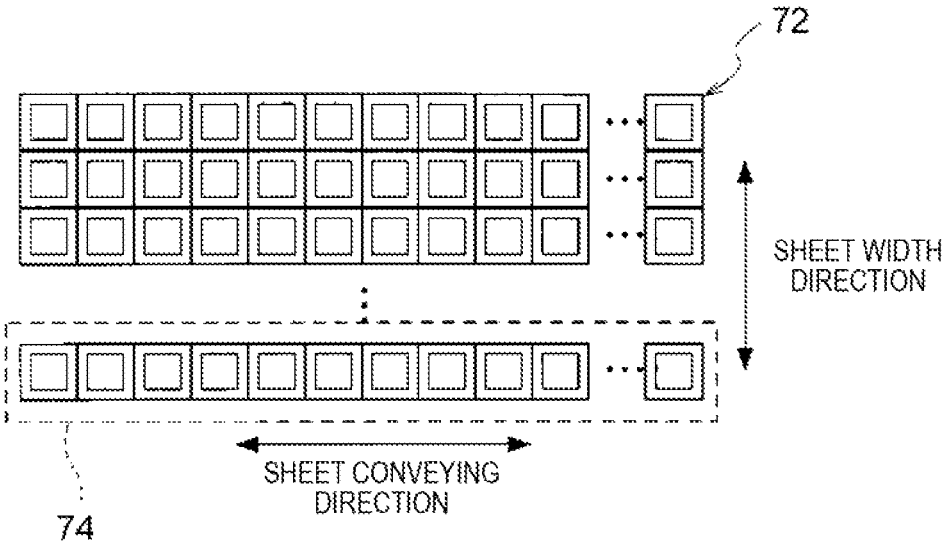
FIG. 2 illustrates an example of a laser illumination surface of a laser drying device.

FIG. 2 illustrates an example of a laser illumination surface of the laser drying device 70. In the meantime, the laser illumination surface of the laser drying device 70 means a surface facing the image formation surface of the continuous sheet P.

As shown in FIG. 2, a plurality of surface-emitting laser elements 72 is arranged in a lattice shape on the laser illumination surface of the laser drying device 70 in the sheet conveying direction and in a sheet width direction orthogonal to the sheet conveying direction. The laser illumination timing and the laser illumination intensity are controlled by the laser driving unit 60 for each surface-emitting laser element 72.

In the meantime, the driving unit by the laser driving unit 60 is just an example. For example, the laser driving unit 60 may be configured to drive each laser block 74 including the plurality of surface-emitting laser elements 72 arranged in a line in the sheet conveying direction.

Here, the surface-emitting laser element 72 is a laser element including vertical resonator laser elements arranged in a lattice shape in the sheet conveying direction and in the sheet width direction, and is also called as a VCSEL (Vertical Cavity Surface Emitting Laser). In the meantime, the number and arrangement shape of the VCSELs 72 arranged on the laser illumination surface of the laser drying device 70 shown in FIG. 2 are just exemplary.

Figure 3:
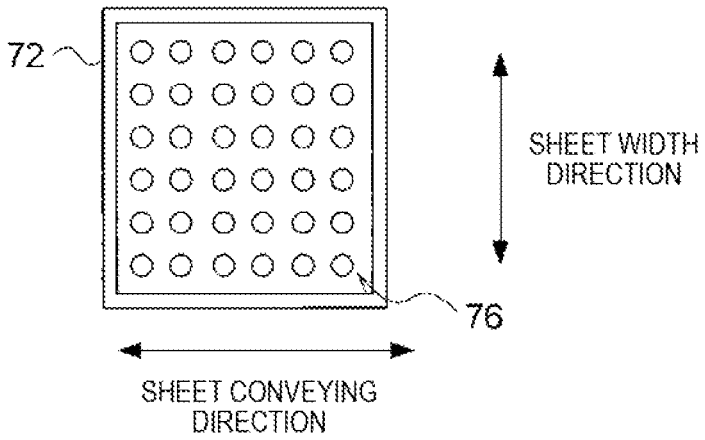
FIG. 3 illustrates an example of a laser illumination surface of a VCSEL.

FIG. 3 illustrates an example of a laser illumination surface of the VCSEL 72 shown in FIG. 2. In the meantime, the laser illumination surface of the VCSEL 72 means a surface facing the image formation surface of the continuous sheet P, like the laser illumination surface of the laser drying device 70.

As described above, a plurality of laser elements 76 is arranged in a lattice shape in the sheet conveying direction and in the sheet width direction on the laser illumination surface of the VCSEL 72, and the laser is illuminated from each laser element 76 in accordance with the driving control of the VCSEL 72. In the meantime, the number and arrangement shape of the laser elements 76 arranged on the VCSEL 72 shown in FIG. 3 are just exemplary.

Subsequently, a relation between a laser illumination range of the VCSEL 72 of this illustrative embodiment and the ink droplet included in the laser illumination range is described.

The printing head 50 of this illustrative embodiment has a printing resolution of 600 dpi (dots per inch) in both the sheet conveying direction and the sheet width direction, for example. Also, the laser drying device 70 of this illustrative embodiment has a light emitting resolution of 600 dpi in both the sheet conveying direction and the sheet width direction. Therefore, in the inkjet recording apparatus 10 of this illustrative embodiment, the laser illumination range of the VCSEL 72 and the ink droplet corresponds to each other one to one. That is, one ink droplet is included in the laser illumination range of one VCSEL 72.

Also, regarding the continuous sheet P of this illustrative embodiment, a recording medium on which an edge line, a ruled line and the like are printed in advance is used.

In this case, the inkjet recording apparatus 10 is configured to eject the ink droplets on the continuous sheet P having the edge line, the ruled line and the like printed thereon, thereby forming a user image. However, when the ink droplets are ejected to overlap with a printing part printed on the continuous sheet P such as the edge line and the ruled line, a density of the printing part is added to a density of the ink droplets, so that an overall density including the ink droplets and the printing part may be increased higher than the density of the ink droplets. As the density is increased, a laser absorption efficiency is also increased. Therefore, when the laser of which intensity is determined in advance in conformity to an amount of the ink droplets is illuminated from the laser drying device 70, the ink droplets ejected to overlap with the printing part absorb much laser than the ink droplets ejected without overlapping with the printing part, so that the printing part and the ink droplets may be discolored.

Therefore, in the below, the inkjet recording apparatus 10 configured to suppress the discoloring of the printing part even when the ink droplet overlapping with the printing part is included in the laser illumination range of the VCSEL 72 is described.

Figure 4:
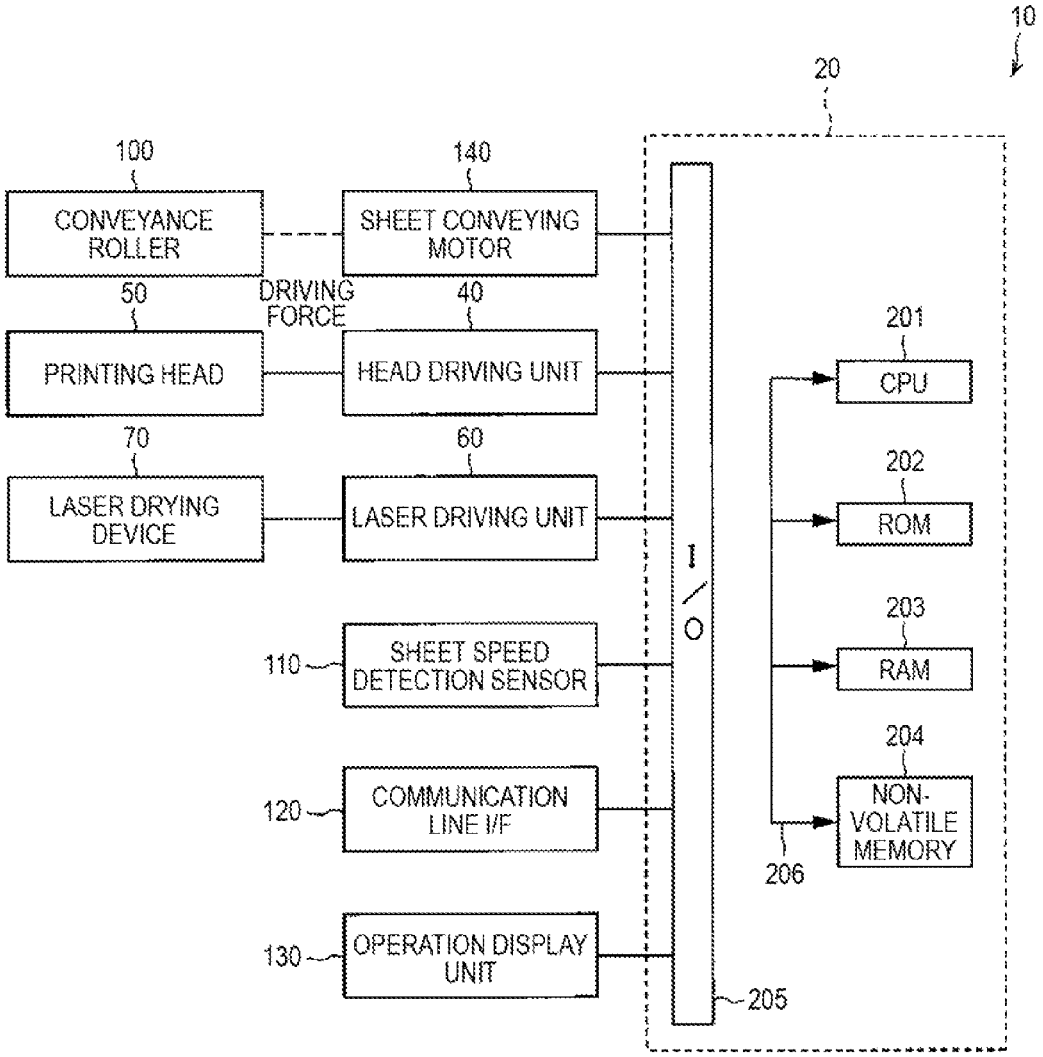
FIG. 4 shows an example of main constitutional parts of an electric system in the inkjet recording apparatus.

FIG. 4 shows main constitutional parts of an electric system in the inkjet recording apparatus 10. The control unit 20 is implemented as a computer 20.

As shown in FIG. 4, a CPU (Central Processing Unit) 201, a ROM (Read Only Memory) 202, a RAM (Random Access Memory) 203, a non-volatile memory 204 and an input/output interface (I/O) 205 of the computer 20 are connected through a bus 206. The I/O 205 is connected with the head driving unit 40, the laser driving unit 60, the sheet speed detection sensor 110, a communication line I/F (interface) 120, an operation display unit 130 and a sheet conveying motor 140. Further, the head driving unit 40 is connected with the printing head 50 and the laser driving unit 60 is connected with the laser drying device 70. Also, the conveyance rollers 100 are connected to the sheet conveying motor 140 through the driving mechanism such as gears. As the sheet conveying motor 140 is driven, the conveyance rollers 100 are rotated.

The computer 20 is configured to execute a program beforehand installed in the ROM 202 by the CPU 201 and to perform data communication with the respective elements connected to the I/O 205 in response to the program, thereby controlling the inkjet recording apparatus 10.

The head driving unit 40 includes a switching element such as a FET for controlling on and off of the printing head 50 and is configured to receive an instruction from the computer 20, thereby driving the switching element.

The printing head 50 includes a piezoelectric element for converting a change of voltage into force, and the like, for example, and is configured to drive the piezoelectric element and the like in response to a driving instruction from the head driving unit 40, thereby ejecting the ink droplets supplied from an ink tank (not shown) from nozzle ejection ports of the printing head 50 towards the continuous sheet P.

The laser driving unit 64 includes a switching element such as a FET for controlling on and off of the VCSEL 72 for each VCSEL 72 included in the laser drying device 70 and is configured to receive an instruction from the computer 20, thereby driving the switching element.

The laser drying device 70 is configured to illuminate the laser of designated intensity from the VCSEL 72 towards the continuous sheet P, in response to a driving instruction from the laser driving unit 60, for example.

The communication line I/F 120 is an interface connected to a communication line (not shown) and configured to perform data communication with an information device (not shown) such as a PC connected to the communication line. The communication line (not shown) may be any of a wired line, a wireless line and a hybrid type of wired and wireless lines and may be configured to receive the user image information from the information device (not shown), for example.

The operation display unit 130 is configured to receive an instruction from a user of the inkjet recording apparatus 10 and to notify the user of a variety of information about operating situations of the inkjet recording apparatus 10. The operation display unit 130 includes, for example, a display button for receiving an operation instruction, which is implemented by a program, a touch panel-type display on which the variety of information is displayed, hardware keys such as ten-key and start button, and the like.

A program is executed, so that processing of the inkjet recording apparatus 10 having the above-described elements can be implemented by software using the computer 20.

In the meantime, the program may be installed in advance in the ROM 22 or may be provided with being stored in a computer-readable recording medium such as a CD-ROM and a memory card. Also, the program may be transmitted via the communication line I/F 120.

In the below, operations of the inkjet recording apparatus 10 of this illustrative embodiment are described in detail.

Figure 5:
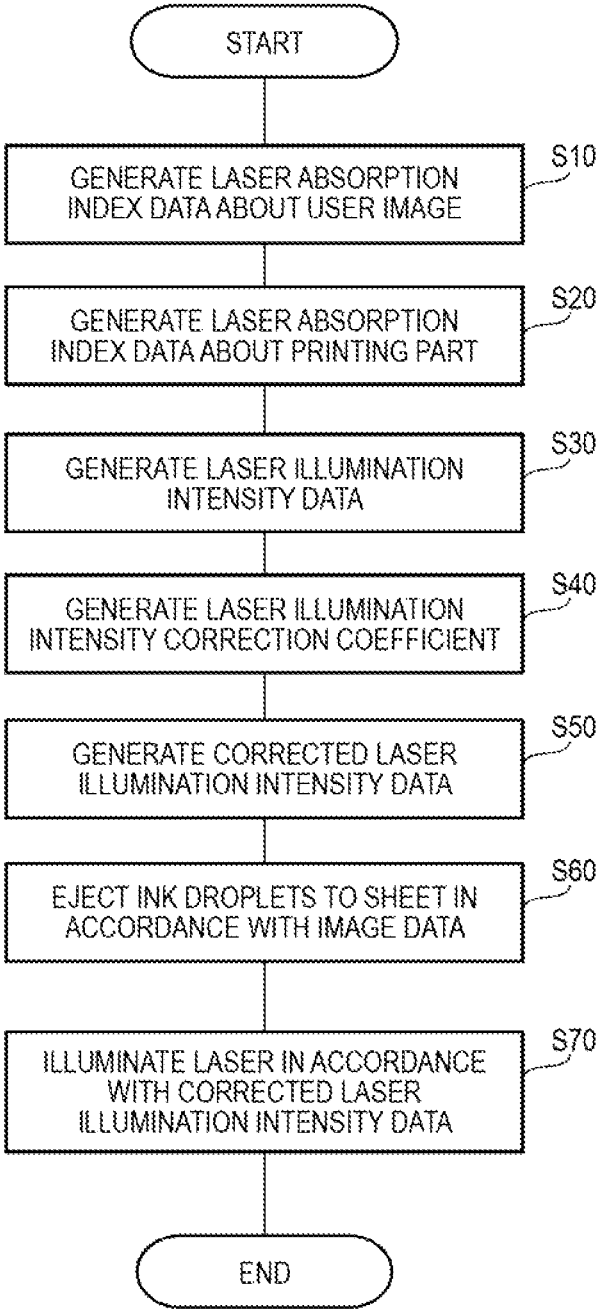
FIG. 5 shows an example of a flowchart of a drying program according to a first illustrative embodiment.

FIG. 5 is a flowchart showing an example of processing of a drying program that is executed by the CPU 201 of the computer 20 when the user image information is received from the user, for example.

Meanwhile, in this illustrative embodiment, the control unit 20 is configured to divide the user image information into blocks having a predetermined size and to execute the drying processing shown in FIG. 5 for each block. Specifically, the control unit 20 is configured to divide the user image information into user image blocks having an area of 60 pixels in both the sheet conveying direction and the sheet width direction and to store the user image information divided into the user image blocks in the storage unit 30, as user image block information. In the meantime, a size of the user image block is exemplary and the present invention is not limited to the area of 60 pixels in both the sheet conveying direction and the sheet width direction.

Also, the image information on the image formation surface of the continuous sheet P before a user image is formed, i.e., the image information on the image formation surface of the continuous sheet P, which is expressed by information including a position of the printing part and a density of the printing part, is divided into blocks having the same size as the user image block and is stored. Here, the image information on the image formation surface of the continuous sheet P is referred to as recording medium image information, an image to be formed on the continuous sheet P by the recording medium image information is referred to as a recording medium image, each block obtained by dividing the recording medium image information is referred to as a recording medium image block and the recording medium image information included in the recording medium image block is referred to as recording medium image block information.

When dividing the user image information into the user image blocks, for example, the control unit 20 specifies the recording medium image blocks, in which the user image expressed by the respective user image blocks is formed, from a positional relation between the user image and the recording medium image, and associates and stores the user image block information of the user image blocks and the recording medium image block information of the recording medium image blocks in the storage unit 30.

In the meantime, the recording medium image information is acquired by reading the image formation surface of the continuous sheet P with a reader (not shown) such as a scanner. When the inkjet recording apparatus 10 includes the reader, the recording medium image information is read by the reader and is then stored in the storage unit 30. When the inkjet recording apparatus 10 does not include the reader, the recording medium image information may be read using a reader provided at an outside of the inkjet recording apparatus 10 and the read recording medium image information may be stored in the storage unit 30 via the communication line I/F 120, for example. Also, when there is image information that was used to print the printing part on the image formation surface of the continuous sheet P, the corresponding image information may be stored in the storage unit 30, as the recording medium image information.

In the meantime, when a plurality of types of continuous sheets P of which positions and densities of the printing parts are different is used for the inkjet recording apparatus 10, the recording medium image information is read for each continuous sheet P and is stored in the storage unit 30. When the user designates a type of the continuous sheet P to be used from the operation display unit 130, the control unit 20 selects the recording medium image block information corresponding to the continuous sheet P of the designated type. However, the method of determining the type of the continuous sheet P to be used is not limited thereto. For example, a camera configured to read the printing part of the continuous sheet P may be provided at an upstream position of the printing head 50 with respect to the sheet conveying direction and the control unit may be configured to determine the type of the continuous sheet P to be used from the information about the position, density and the like of the printing part acquired from the camera.

In order to simplify the descriptions, the drying processing corresponding to one user image block is described. The same processing as the drying processing shown in FIG. 5 is also executed for the other user image blocks, so that an image corresponding to the image information is formed on the continuous sheet P.

First, in step S10, the control unit 20 acquires the user image block information corresponding to the user image block from the storage unit 30.

Figure 6:
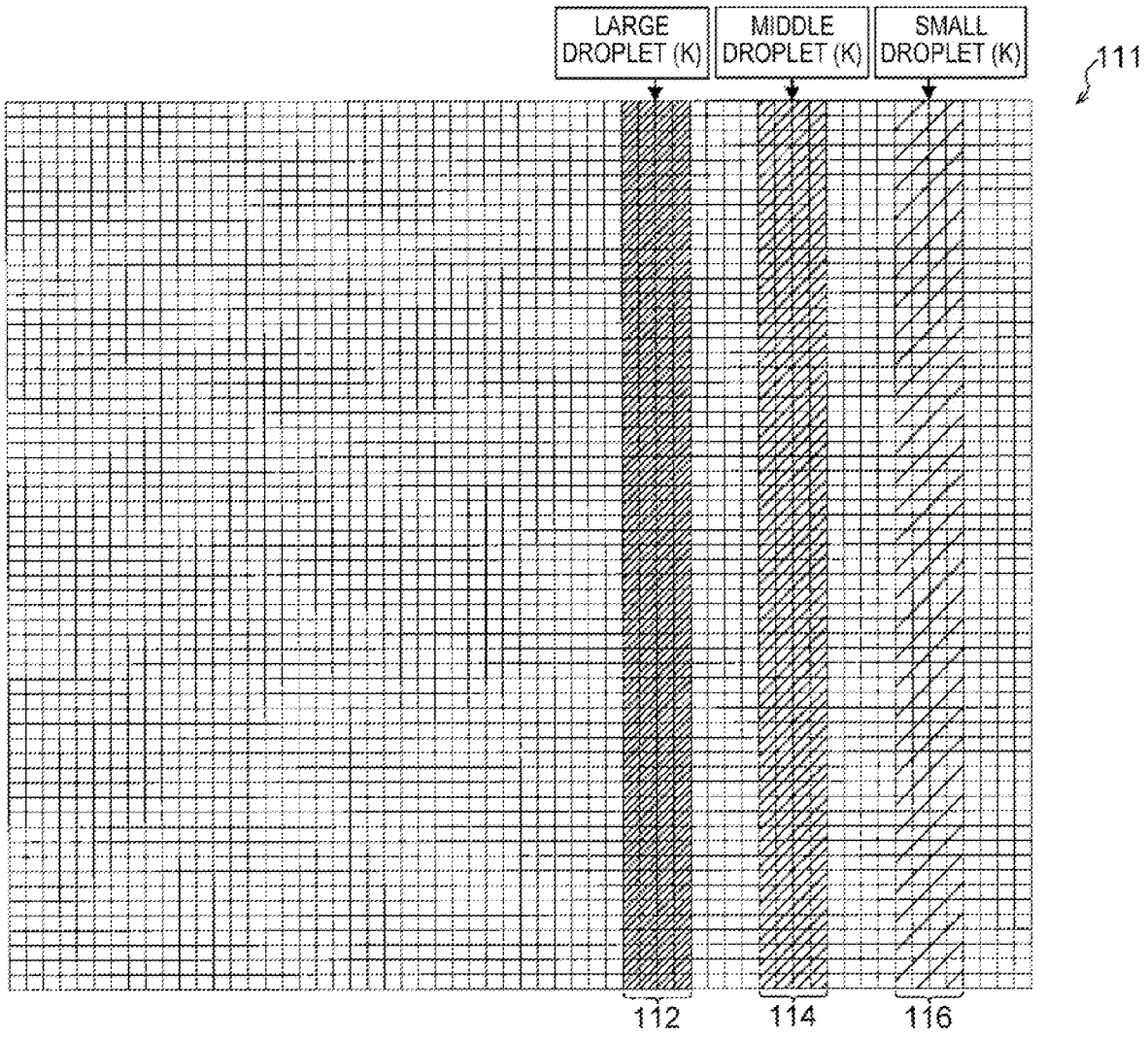
FIG. 6 is a pictorial view illustrating an example of user image block information.

FIG. 6 pictorially illustrates an example of the user image block information. As shown in FIG. 6, the user image block information 111 includes information indicating ejection positions of ink droplets, colors of ink droplets and amounts of ink droplets ejected to the continuous sheet P at the respective positions in the user image block. In the meantime, the amount of the ink droplet is determined by a density of the user image, and a larger amount of ink droplet is required at a place of a higher density.

In the user image block information 111 exemplified in FIG. 6, a large droplet image area 112 is an area in which black (K) ink droplets of large droplets are ejected. Also, a middle droplet image area 114 is an area in which black (K) ink droplets of middle droplets are ejected and a small droplet image area 116 is an area in which black (K) ink droplets of small droplets are ejected. Here, the large droplet refers to a droplet amount of about 11 pL, the middle droplet refers to a droplet amount of about 8 pL and the small droplet refers to a droplet amount of about 5 pL.

Also, here, black (K) is designated as the colors of the large droplet image area 112, the middle droplet image area 114 and the small droplet image area 116. However, it should be noted that the designated colors of the respective image areas are not limited to black (K).

The control unit 20 is configured to generate user image laser absorption index data from the user image block information 111 by referring to a user image laser absorption index conversion table stored in advance in the storage unit 30.

FIG. 7 shows an example of the user image laser absorption index conversion table. As shown in FIG. 7, the user image laser absorption index conversion table 118 is a table for setting a laser absorption index of each pixel in the user image block from a combination of a color of ink droplet and a droplet amount of ink droplet.

For example, in case that a color of ink droplet is black (K), when a droplet amount of ink droplet in a pixel is the large droplet, "3" is set as the laser absorption index, when a droplet amount is the middle droplet, "2" is set as the laser absorption index, and when a droplet amount is the small droplet, "1" is set as the laser absorption index. Also, for each color of YMC, the same values as black (K) are set by the droplet amounts of ink droplet. The laser absorption index is an index indicating a degree of laser absorption. The larger laser absorption index indicates the higher degree of laser absorption. As the droplet amount of ink droplet increases, an amount of a laser absorption material (carbon, IR absorption agent and the like) included in the ink droplet increases. Therefore, the larger laser absorption index is set for the large droplet.

In the meantime, the user image laser absorption index conversion table 118 shown in FIG. 7 is exemplary and the setting values indicating the laser absorption indexes may be changed depending on an amount of the IR absorption agent included in each color of YMCK, for example. Also, the droplet amount of ink droplet may be classified into three types, five types and the like different from the above four types of the large droplet, the middle droplet, the small droplet and no ink droplet.

Figure 8:
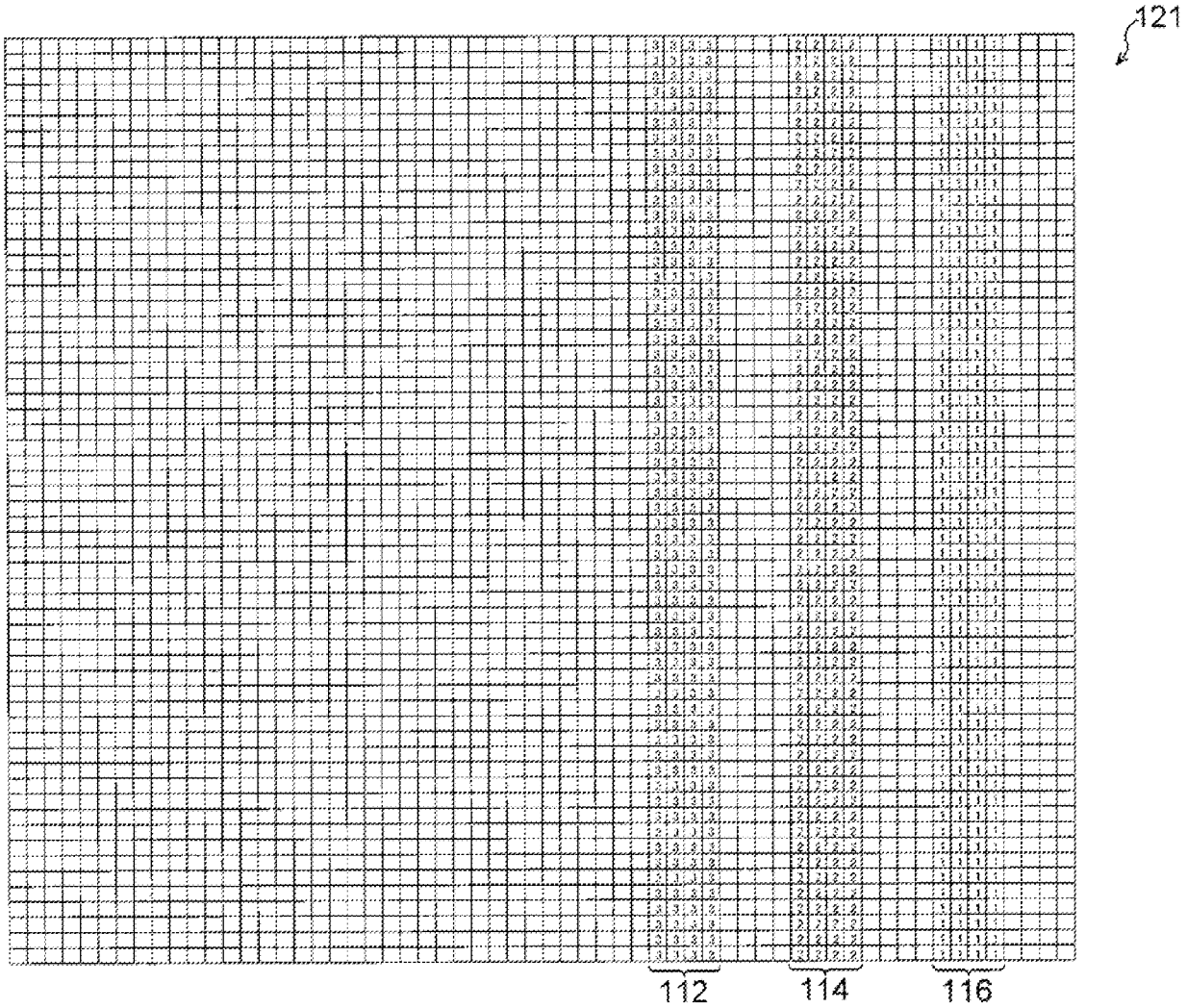
FIG. 8 illustrates an example of user image laser absorption index data.

FIG. 8 illustrates an example of user image laser absorption index data that is generated from the user image block information 111 by referring to the user image laser absorption index conversion table 118 shown in FIG. 7.

In this case, in the user image laser absorption index data 121, "3" is set as the laser absorption index of each pixel in the large droplet image area 112, "2" is set as the laser absorption index of each pixel in the middle droplet image area 114, "1" is set as the laser absorption index of each pixel in the small droplet image area 116 and "0" is set as the laser absorption index of each pixel for which it is not necessary to eject the ink droplet. In the meantime, when the laser absorption index is "0", a square indicating a pixel is empty without describing the numerical value of 0, in the user image laser absorption index data 121.

By the above, the user image laser absorption index data 121 corresponding to the user image block information is generated.

Then, in step S20, the control unit 20 acquires the recording medium image block information associated with the user image block information acquired in the processing of step S10 from the storage unit 30.

Figure 9:
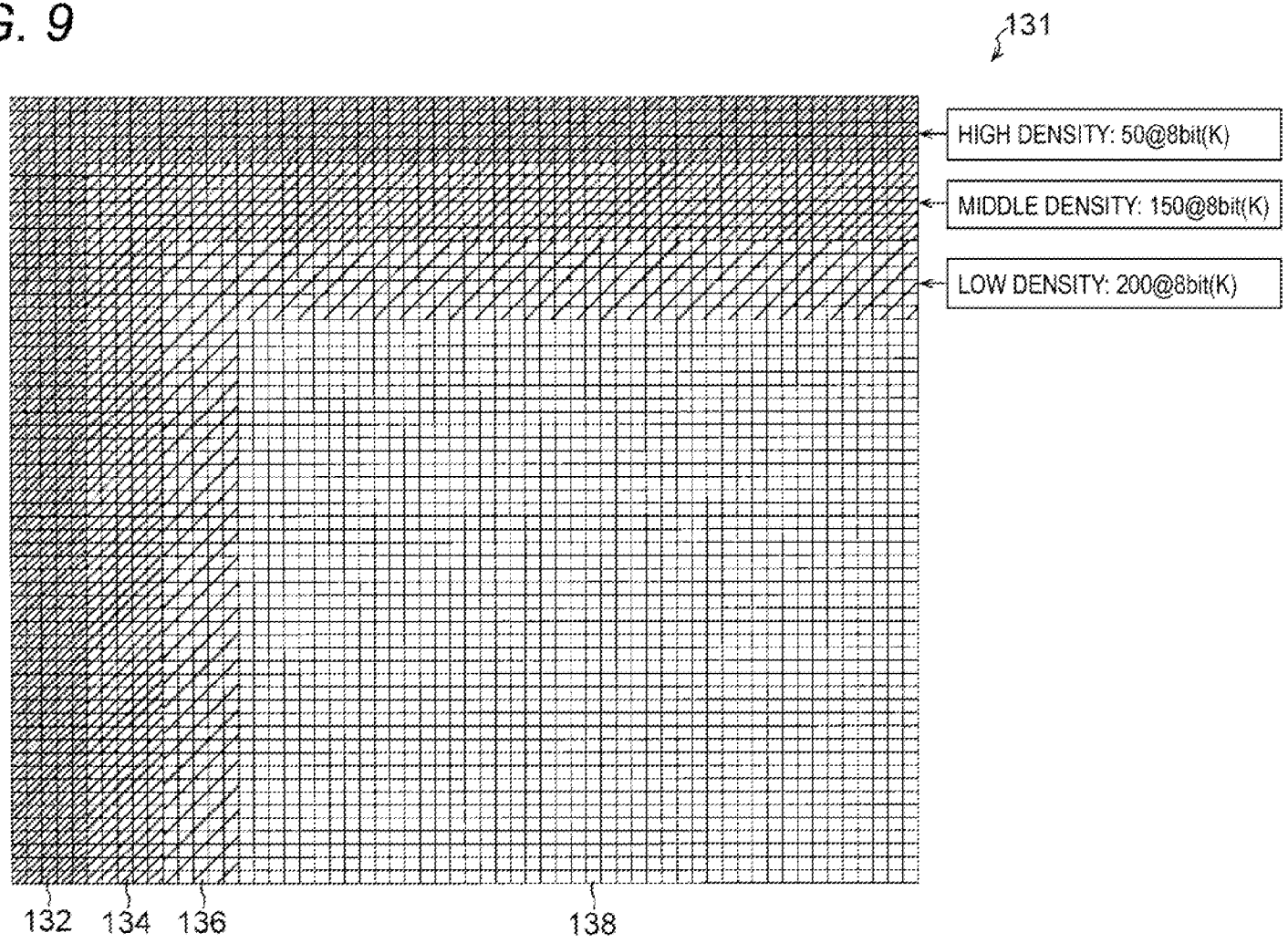
FIG. 9 is a pictorial view illustrating an example of recording medium image block information.

FIG. 9 pictorially illustrates an example of the recording medium image block information. As shown in FIG. 9, the recording medium image block information 131 is information indicating positions of printing parts, colors of printing parts and densities of printing parts at the respective positions in the recording medium image block.

In the recording medium image block information 131 exemplified in FIG. 9, a high density printing area 132 is an area including a high density printing part. Also, a middle density printing area 134 is an area including a middle density printing part and a low density printing area 136 is an area including a low density printing part. Here, when a density value of each pixel is expressed with 8 bits, i.e., 256 gradations, the high density means that a density value of a pixel is 0 or greater and 63 or less, the middle density means that a density value of a pixel is 64 or greater and 191 or less and the low density means that a density value of a pixel is 192 or greater and 223 or less. Like this, in the recording medium image block information 131 of this illustrative embodiment, the higher density of the printing part, the smaller density value is set.

In the meantime, an area of which a density value of a pixel is 224 or greater and 255 or less is treated as a non-printing area 138 of which a printing part is not included on the continuous sheet P. In the meantime, a density of which a density value of a pixel is 224 or greater and 255 or less may also be referred to as a non-density. Also, the ranges of the density value indicating the high density, the middle density, the low density and the non-density are exemplary and are not limited to the above-described ranges.

Also, black (K) is exemplarily designated as the colors of the high density printing area 132, the middle density printing area 134, the low density printing area 136 and the non-printing area 138. However, it should be noted that the designated colors of the respective printing areas is not limited to black (K).

The control unit 20 is configured to generate recording medium laser absorption index data from the recording medium image block information 131 by referring to a recording medium laser absorption index conversion table stored in advance in the storage unit 30.

FIG. 10 shows an example of the recording medium laser absorption index conversion table. As shown in FIG. 10, the recording medium laser absorption index conversion table 141 is a table for setting a laser absorption index of each pixel in the recording medium image block from a combination of a color of the printing part and a density of the printing part.

For example, in case that a color of the printing part is black (K), when a density of a pixel is the high density, "3" is set as the laser absorption index, when a density of a pixel is the middle density, "2" is set as the laser absorption index, when a density of a pixel is the low density, "1" is set as the laser absorption index, and when a density of a pixel is the non-density, "0" is set as the laser absorption index. The reason is that the laser absorption efficiency becomes higher at the higher density part. Also, for each color of YMC, the laser absorption indexes of "0" or larger and "2" or smaller are set by the pixel density, as shown in FIG. 10.

In the meantime, the recording medium laser absorption index conversion table 141 may be set so that even when the densities of the printing parts are the same high density, the laser absorption indexes become different by colors of the printing part. The reason is as follows: the printing part of black (K) can absorb the laser more easily than cyan (C) and magenta (M) and the printing part of yellow (Y) is more difficult to absorb the laser than cyan (C) and magenta (M), so that the corresponding properties are reflected in the recording medium laser absorption index conversion table 141.

Also, the recording medium laser absorption index conversion table 141 shown in FIG. 10 is just exemplary and the setting values indicating the laser absorption indexes may be changed depending on an amount of the IR absorption agent included in each color of YMCK, for example. Also, the density of an image may be classified into any number of classifications other than the above four types of the high density, the middle density, the low density and the non-density.

Also, since the laser absorption amount of the printing part may also be changed depending on humidity, the humidity may be measured by a humidity sensor (not shown) and the setting values indicating the laser absorption indexes may be changed depending on the humidity.

Figure 11:
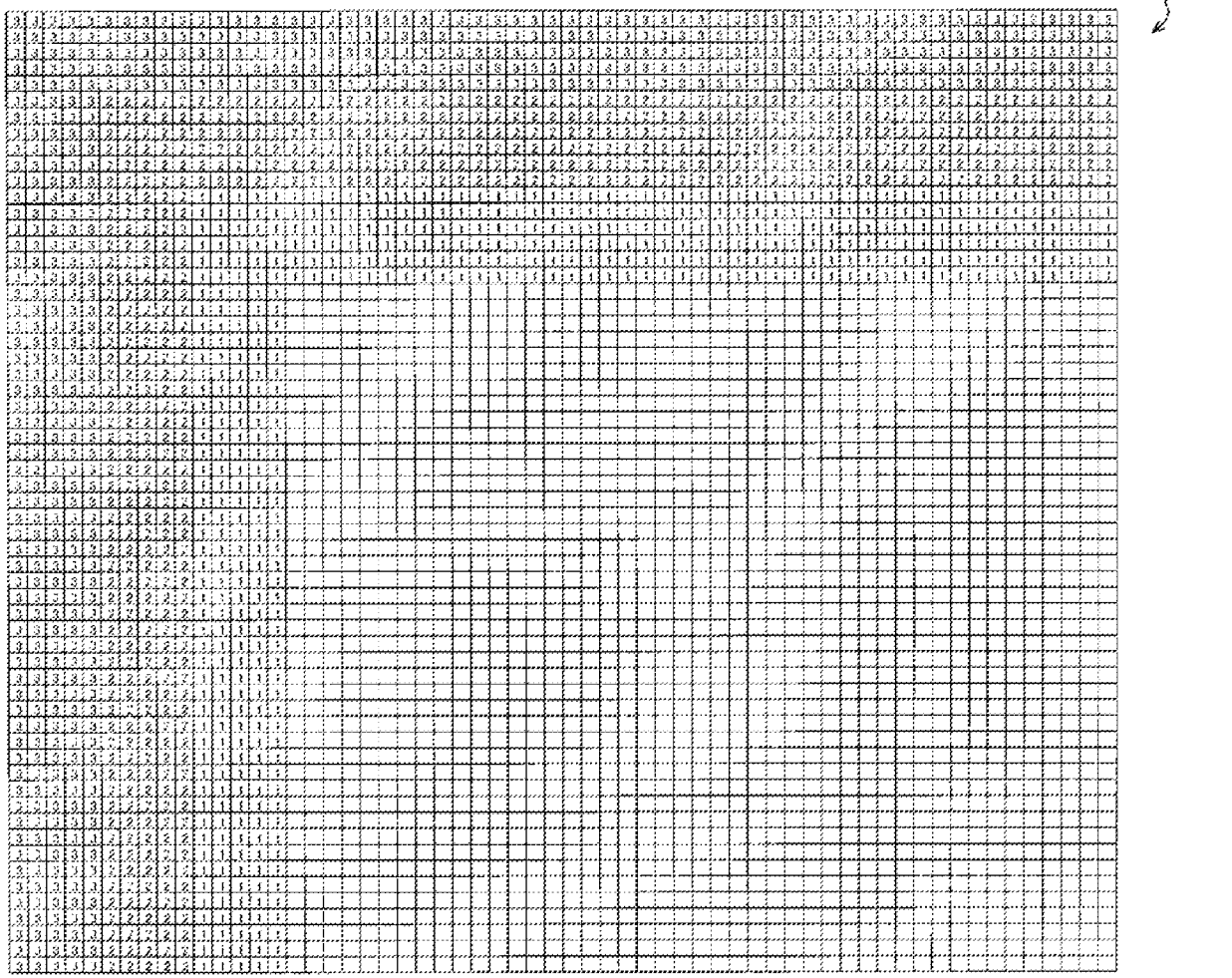
FIG. 11 illustrates an example of recording medium laser absorption index data.

FIG. 11 illustrates an example of recording medium laser absorption index data that is generated from the recording medium image block information 131 by referring to the recording medium laser absorption index conversion table 141 shown in FIG. 10.

In this case, in the recording medium laser absorption index data 142, "3" is set as the laser absorption index of each pixel in the high density printing area 132, "2" is set as the laser absorption index of each pixel in the middle density printing area 134, "1" is set as the laser absorption index of each pixel in the low density printing area 136 and "0" is set as the laser absorption index of each pixel in the non-printing area 138.

In the meantime, when the laser absorption index is "0", a square indicating a pixel is empty without describing the numerical value of 0, in the recording medium laser absorption index data 142.

By the above, the recording medium laser absorption index data 142 corresponding to the recording medium image block information is generated.

Then, in step S30, the control unit 20 generates laser illumination intensity data by using the user image block information 111 acquired in the processing of step S10 by referring to a laser illumination intensity conversion table beforehand stored in the storage unit 30.

FIG. 12 shows an example of the laser illumination intensity conversion table. As shown in FIG. 12, the laser illumination intensity conversion table 150 is a table for setting a laser illumination intensity to be illuminated from the VCSEL 72 to each pixel in the user image block, on the basis of the combination of the color of ink droplet and the droplet amount of ink droplet.

For example, in case that a color of the ink droplet is black (K), when a droplet amount of the ink droplet in the pixel is the large droplet, 3 [J/cm$^2$] is set as the laser illumination intensity of the VCSEL 72, when a droplet amount of the ink droplet is the middle droplet, 2 [J/cm$^2$] is set as the laser illumination intensity of the VCSEL 72, when a droplet amount of the ink droplet is the small droplet, 1 [J/cm$^2$] is set as the laser illumination intensity of the VCSEL 72, and when the ink droplet is not ejected, 0 [J/cm$^2$] is set as the laser illumination intensity of the VCSEL 72. Also, for each color of YMC, the same values as black (K) are set by the droplet amounts of ink droplet.

In the meantime, the laser illumination intensity conversion table 150 shown in FIG. 12 is exemplary and the setting values indicating the laser illumination intensities may be changed depending on an amount of the IR absorption agent included in each color of YMCK, for example. Also, the droplet amount of ink droplet may be classified into three types, five types and the like different from the above four types of the large droplet, the middle droplet, the small droplet and no ink droplet.

Figure 13:
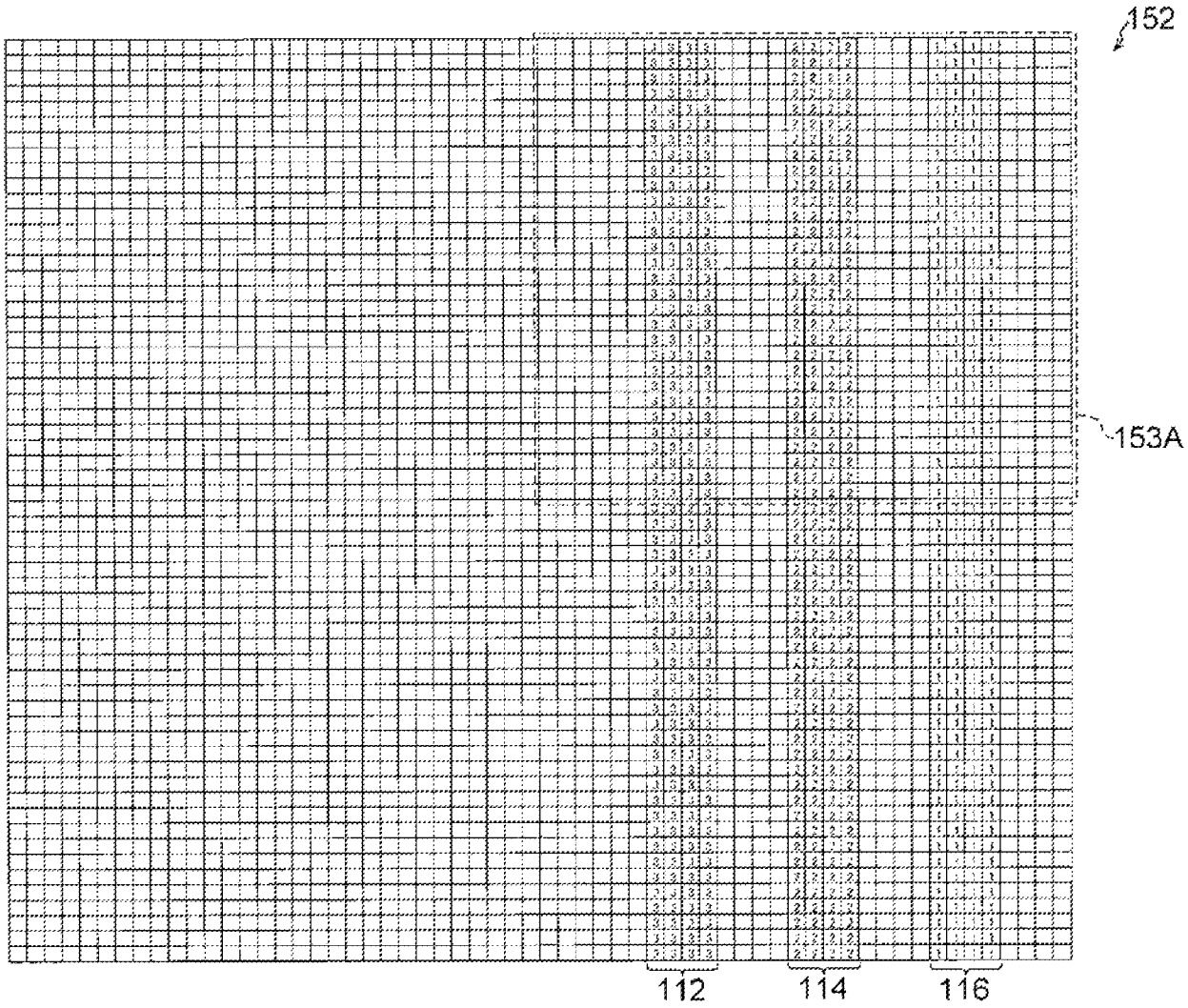
FIG. 13 illustrates an example of laser illumination intensity data.

FIG. 13 illustrates an example of laser illumination intensity data that is generated from the user image block information 111 by referring to the laser illumination intensity conversion table 150 shown in FIG. 12.

In this case, in the laser illumination intensity data 152, "3" is set as the laser illumination intensity of each pixel in the large droplet image area 112, "2" is set as the laser illumination intensity of each pixel in the middle droplet image area 114, "1" is set as the laser illumination intensity of each pixel in the small droplet image area 116 and "0" is set as the laser illumination intensity of each pixel for which it is not necessary to eject the ink droplet.

In the meantime, when the laser illumination intensity is "0", a square indicating a pixel is empty without describing the numerical value of 0, in the laser illumination intensity data 152.

The setting value for each pixel in the laser illumination intensity data 152 set as described above indicates the laser illumination intensity of each VCSEL 72 configured to illuminate each pixel.

In step S40, the control unit 20 generates a laser illumination intensity correction coefficient table for correcting the laser illumination intensity data 152 so that the laser illumination intensity to a pixel, in which a printing part having the low density or higher and a user image for which an ink droplet having a droplet amount of the small droplet or larger is ejected overlap with each other, becomes lower than the laser illumination intensity set in the laser illumination intensity data 152 generated in the processing of step S30. Meanwhile, hereinafter, the pixel corresponding to a position at which a printing part having the low density or higher and a user image for which an ink droplet having a droplet amount of the small droplet or larger is ejected overlap with each other is referred to as an overlapping pixel.

Regarding a calculation equation for calculating a laser illumination intensity correction coefficient for each pixel in the laser illumination intensity correction coefficient table, any calculation equation may be used inasmuch as the laser illumination intensity to the overlapping pixel is corrected to a value smaller than the setting value of the laser illumination intensity data 152 corresponding to the overlapping pixel.

For example, the control unit 20 is configured to calculate a laser illumination intensity correction coefficient Ci for each pixel i in the laser illumination intensity correction coefficient table by using an equation (1).

$$Ci=Ai/(Ai+Bi) \quad (1)$$

Here, i indicates a suffix for identifying each pixel included in the user image block, Ai indicates a setting value of the user image laser absorption index data 121 corresponding to a pixel i, and Bi indicates a setting value of the recording medium laser absorption index data 142 corresponding to a pixel i.

Figure 14:
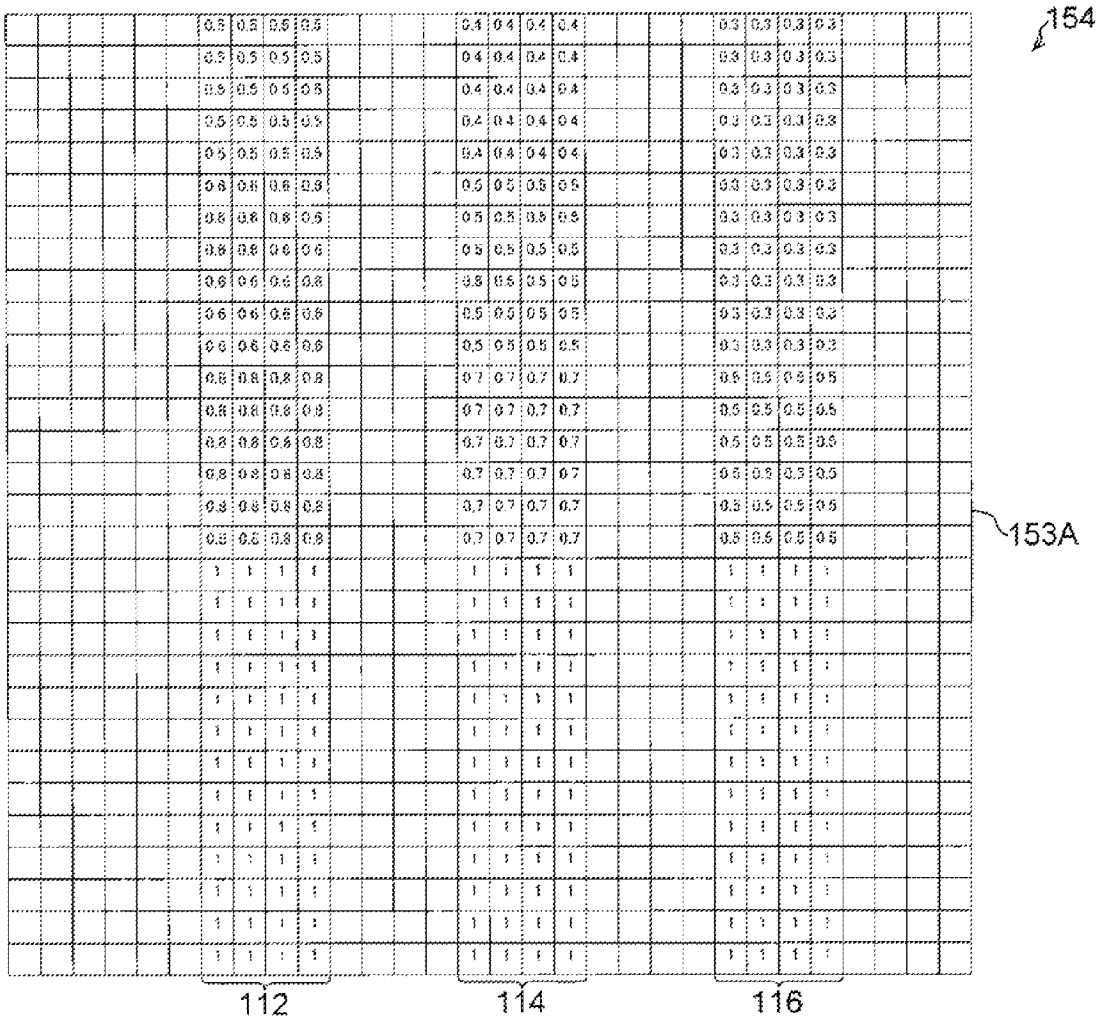
FIG. 14 shows an example of a laser illumination intensity correction coefficient table.

FIG. 14 illustrates an example of the laser illumination intensity correction coefficient table that is generated by assigning respective setting values of the user image laser absorption index data 121 and the recording medium laser absorption index data 142 for a pixel i to the equation (1). In the meantime, the laser illumination intensity correction coefficient table 154 shown in FIG. 14 shows the laser illumination intensity correction coefficients of an area corresponding to an area 153A in FIG. 13, which are selected from the laser illumination intensity correction coefficient table generated from the user image laser absorption index data 121 and the recording medium laser absorption index data 142, for convenience of explanations. However, actually, the laser illumination intensity correction coefficient table 154 is a table including the laser illumination intensity correction coefficients of 60 pixels×60 pixels.

Like this, when the equation (1) is used, the laser illumination intensity correction coefficient of an overlapping pixel is smaller than 1 in the laser illumination intensity correction coefficient table 154.

In the meantime, when the laser illumination intensity correction coefficient is "0", a square indicating a pixel is empty without describing the numerical value of 0, in the laser illumination intensity correction coefficient table 154.

By the above, the laser illumination intensity correction coefficient table 154 is generated.

Then, in step S50, the control unit 20 corrects the laser illumination intensity data 152 generated in step S30 by using the laser illumination intensity correction coefficient table 154 generated in step S40.

Specifically, the control unit 20 corrects the laser illumination intensity data 152 by multiplying the laser illumination intensity of the laser illumination intensity data 152 and the laser illumination intensity correction coefficient of the laser illumination intensity correction coefficient table 154 for each pixel.

Figure 15:
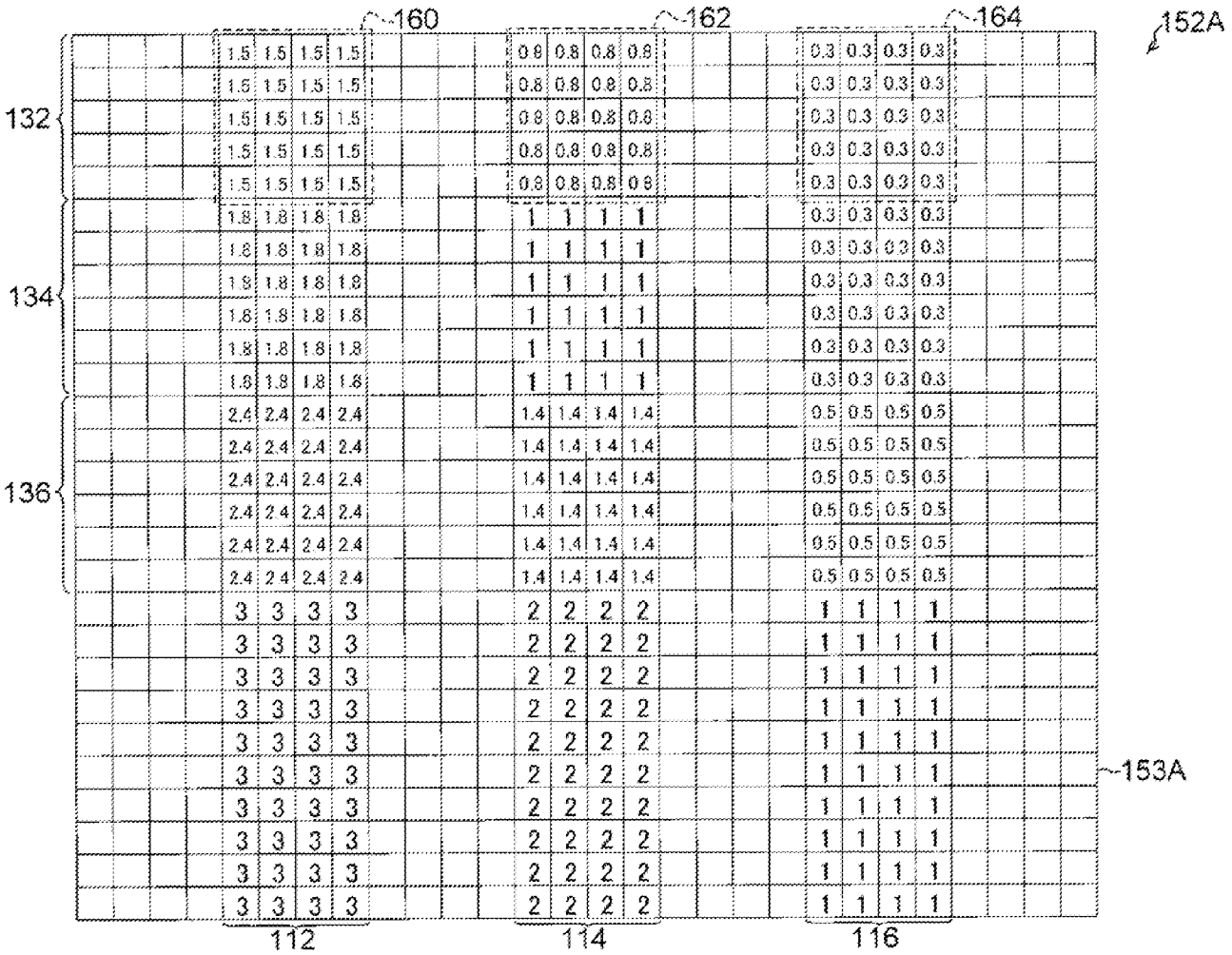
FIG. 15 illustrates an example of corrected laser illumination intensity data.

FIG. 15 illustrates an example of corrected laser illumination intensity data. As shown in FIG. 15, in corrected laser illumination intensity data 152A, which is the corrected laser illumination intensity data, the laser illumination intensity corresponding to the overlapping pixel becomes lower than the laser illumination intensity of the laser illumination intensity data 152 corresponding to the same overlapping pixel.

For example, in an area 160 including the overlapping pixels of the large droplet image area 112 and the high density printing area 132, the laser illumination intensity is reduced from 3 [J/cm$^2$] to 1.5 [J/cm$^2$], and in an area 162 including the overlapping pixels of the middle droplet image area 114 and the high density printing area 132, the laser illumination intensity is reduced from 2 [J/cm$^2$] to 0.8 [J/cm$^2$]. Also, in an area 164 including the overlapping pixels of the small droplet image area 116 and the high density printing area 132, the laser illumination intensity is reduced from 1 [J/cm$^2$] to 0.3 [J/cm$^2$]. Likewise, the laser illumination intensity in an area including the other overlapping pixels is also reduced, as compared to the laser illumination intensity of the laser illumination intensity data 152.

In the meantime, when the laser illumination intensity is 0 [J/cm$^2$], a square indicating a pixel is empty without describing the numerical value of 0, in the corrected laser illumination intensity data 152A.

In step S60, the control unit 20 controls the head driving unit 40 to eject the ink droplets of the designated colors from the printing head 50 to the ejection positions of the continuous sheet P, which are designated with the user image block information 111 acquired from the storage unit 30 in the processing of step S10, by the designated amounts.

Then, in step S70, the control unit 20 controls the laser driving unit 64) so that the laser is illuminated from the VCSELs 72 to the ink droplets at timings at which the respective ink droplets on the continuous sheet P are conveyed into the laser illumination ranges of the corresponding VCSELs 72.

As described above, according to the inkjet recording apparatus 10 of this illustrative embodiment, the laser illumination intensity of the VCSEL 72 configured to illuminate the laser to the ink droplet of the overlapping pixel is reduced, as compared to the laser illumination intensity set by the laser illumination intensity data 152, and then the laser is illuminated from the VCSEL 72.

Therefore, as compared to a configuration where the laser is illuminated from the VCSEL 72 of the laser drying device 70 to the ink droplet and the printing part with the laser illumination intensity of the laser illumination intensity data 152 set by the color and droplet amount of the ink droplet of the overlapping pixel, it is possible to suppress the discoloring of the printing part and ink droplet of the overlapping pixel.

(Second Illustrative Embodiment)

In the below, operations of the inkjet recording apparatus 10 of a second illustrative embodiment of the present invention will be described in detail.

In the inkjet recording apparatus 10 of the first illustrative embodiment, the printing resolution of the printing head 50 is 600 dpi in both the sheet conveying direction and the sheet width direction and the light emitting resolution of the laser drying device 70 is also 600 dpi in both the sheet conveying direction and the sheet width direction. That is, in the inkjet recording apparatus 10 of the first illustrative embodiment, the laser illumination range of the VCSEL 72 and the ink droplet correspond to each other one to one.

Figure 16:
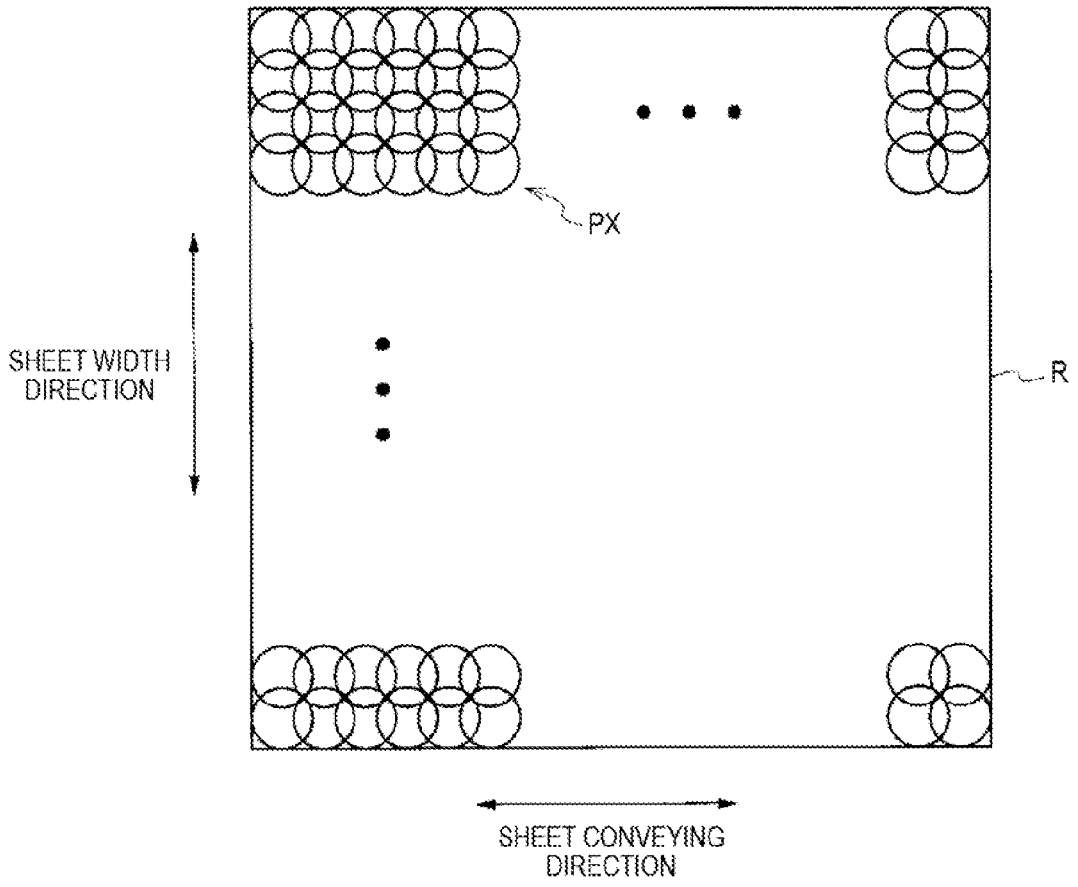
FIG. 16 is a pictorial view illustrating an example of a positional relation between a laser illumination range R of the VCSEL and liquid droplets.

However, in the inkjet recording apparatus 10 of the second illustrative embodiment, the printing resolution of the printing head is 600 dpi in both the sheet conveying direction and the sheet width direction but the light emitting resolution of the laser drying device is set to be lower than the printing resolution. Specifically, the light emitting resolution of the laser drying device of the second illustrative embodiment is 20 dpi in both the sheet conveying direction and the sheet width direction. That is, as shown in FIG. 16, 30 ink droplets PX are included in a laser illumination range R on the continuous sheet P illuminated by one VCSEL in both the sheet conveying direction and the sheet width direction, respectively.

The main constitutional parts of the inkjet recording apparatus 10 according to the second illustrative embodiment are the same as FIG. 1, except that the light emitting resolution of the laser drying device is different from the light emitting resolution of the laser drying device 70 according to the first illustrative embodiment. Therefore, the main configuration of the electric system of the inkjet recording apparatus 10 according to the second illustrative embodiment is also the same as FIG. 4.

Meanwhile, hereinafter, the laser drying device of the second illustrative embodiment is referred to as a laser drying device 70', and the VCSEL is referred to as a VCSEL 72'.

Figure 17:
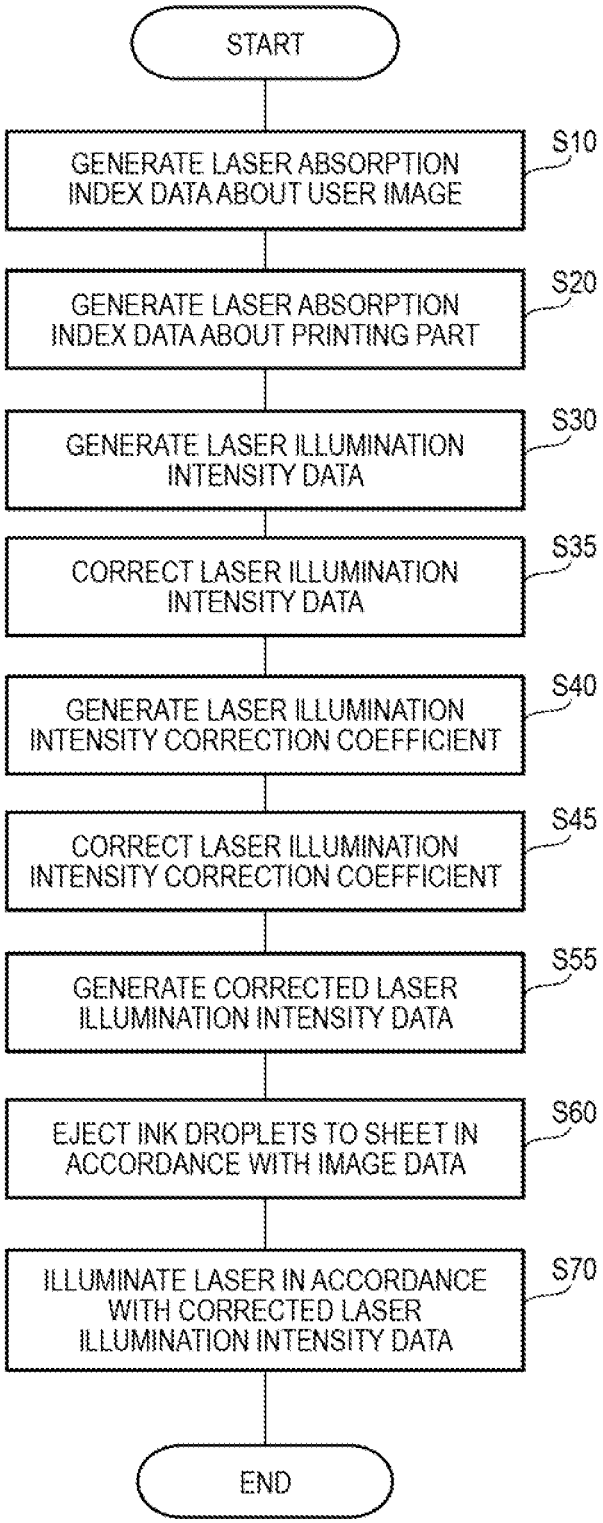
FIG. 17 shows an example of a flowchart of a drying program according to a second illustrative embodiment.

Also, FIG. 17 is a flowchart showing an example of processing of a drying program according to the second illustrative embodiment, which is executed by the CPU 201 of the computer 20 when the user image information is received from the user.

The flowchart shown in FIG. 17 is different from FIG. 5 showing an example of the flowchart of the drying processing according to the first illustrative embodiment, in that steps S35 and S45 are added and the processing of step S50 is replaced with step S55. Therefore, the processing of steps S35, S45 and S55 is focused in the below descriptions.

In step S35, the control unit 20 corrects the laser illumination intensity data 152 generated in the processing of step S30, in conformity to the light emitting resolution of the laser drying device 70'. First, the control unit 20 divides the laser illumination intensity data 152 for each laser illumination range R.

Figure 18:
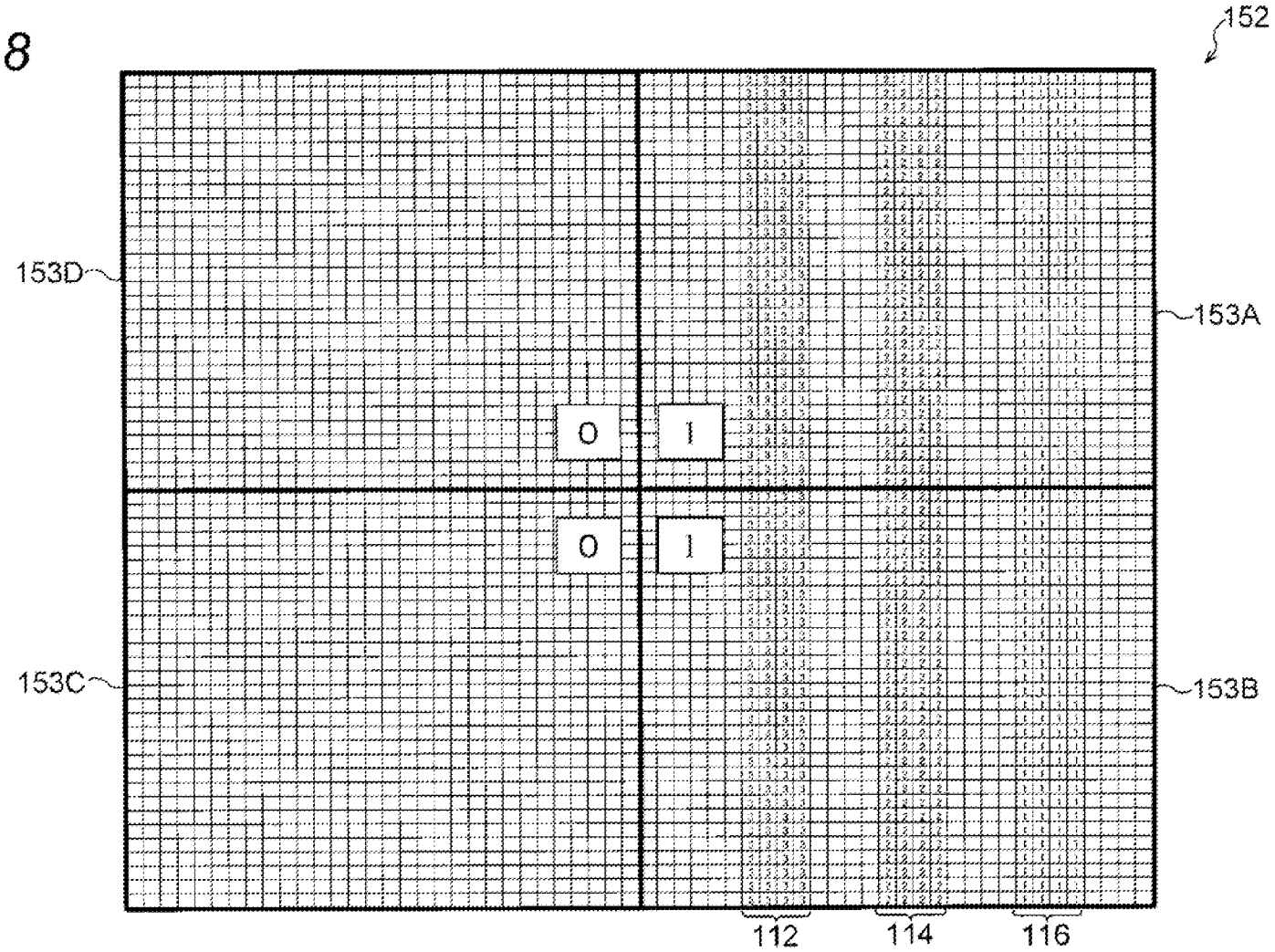
FIG. 18 illustrates an example of a positional relation between laser illumination intensity data 152 and the laser illumination range R of the VCSEL.

FIG. 18 illustrates an example of a relation between the laser illumination intensity data 152 for each pixel generated in the processing of step S30 and the laser illumination range R of the VCSEL 72'.

In the example of FIG. 18, the laser illumination intensity data 152 is divided into four areas 153A, 153B, 153C, 153D. Each of the areas 153A to 153D indicates the laser illumination range R of the VCSEL 72'.

Since the laser illumination intensity is adjusted for each VCSEL 72', the laser illumination intensity cannot be adjusted for each area smaller than the areas 153A to 153D. Therefore, the control unit 20 should set the laser illumination intensity data for each range of the areas 153A to 153D.

At this time, the control unit 20 sets the laser illumination intensity data for each of the areas 153A to 153D by using the laser illumination intensity data 152 set for each pixel included in the respective areas 153A to 153D.

For example, the control unit 20 sets the lowest laser illumination intensity of the laser illumination intensity data 152 included in each area, as the laser illumination intensity for the corresponding area, for each of the areas 153A to 153D. Here, the lowest laser illumination intensity means the lowest laser illumination intensity of the laser illumination intensities of the laser illumination intensity data 152 corresponding to the ejection positions of the respective ink droplets on the continuous sheet P, in an area including at least one or more ink droplets. In an area not including the ink droplet, the laser illumination intensity is 0 [J/cm$^2$].

That is, the laser illumination intensity of the areas 153A. 153B is set to be 1 [J/cm$^2$] and the laser illumination intensity of the areas 153C, 153D is set to be 0 [J/cm$^2$].

The reason to set, as the laser illumination intensity of each of the areas 153A to 153D, the lowest laser illumination intensity of the laser illumination intensities set in the laser illumination intensity data 152 in the corresponding area is so as not to illuminate the laser exceeding the illumination intensity necessary for the drying, which is set in the laser illumination intensity data 152, to the ink droplets included in each of the areas 153A to 153D.

In the meantime, the method of setting the laser illumination intensity in each of the areas 153A to 153D is not limited to the above described method. For example, the laser illumination intensity in each of the areas 153A to 153D may be set by a weighted average of the laser illumination intensity in each area. Here, the weighted average of the laser illumination intensity in each area means a value that is obtained by dividing a sum of the laser illumination intensities of the respective pixels included in an area by the number of pixels included in the area, in the laser illumination intensity data 152.

In this case, the laser illumination intensity is set in conformity to a distribution situation of the laser illumination intensities set for respective pixels in the area. For example, in case that the laser illumination intensity of 1 [J/cm$^2$] is set for one pixel and the laser illumination intensity of 3 [J/cm$^2$] is set for the other pixels in the area 153A, when the laser illumination intensity of the area 153A is set by the weighted average, not 1 [J/cm$^2$], the deterioration of the image quality of the user image may be overall suppressed in some cases. The reason is that even when the laser having the intensity exceeding 1 [J/cm$^2$] is illuminated to the pixel of which the laser illumination intensity is set to 1 [J/cm$^2$] and the ink droplet is thus discolored, it may be difficult to recognize the discoloring.

Then, in step S45, the control unit 20 corrects the laser illumination intensity correction coefficient table 154 generated in the processing of step S40, in conformity to the light emitting resolution of the laser drying device 70'.

For example, the control unit 20 divides the laser illumination intensity correction coefficient table 154 into the same four areas as the areas 153A to 153D shown in FIG. 18. Then, the control unit 20 sets, as the laser illumination intensity correction coefficient of the area 153A, the smallest laser illumination intensity correction coefficient of the laser illumination intensity correction coefficient table 154 (refer to FIG. 14) corresponding to the area 153A, and corrects the laser illumination intensity correction coefficient table 154 generated in step S40. Further, the control unit 20 sets the laser illumination intensity correction coefficients of the areas 153B to 153D in the same manner.

Here, the smallest laser illumination intensity correction coefficient of each of the areas 153B to 153D means the smallest laser illumination intensity correction coefficient of the laser illumination intensity correction coefficients corresponding to the ejection positions of the respective ink droplets on the continuous sheet P, in an area including at least one or more ink droplets. In an area not including the ink droplet, the smallest laser illumination intensity correction coefficient is 0.

Figure 19:
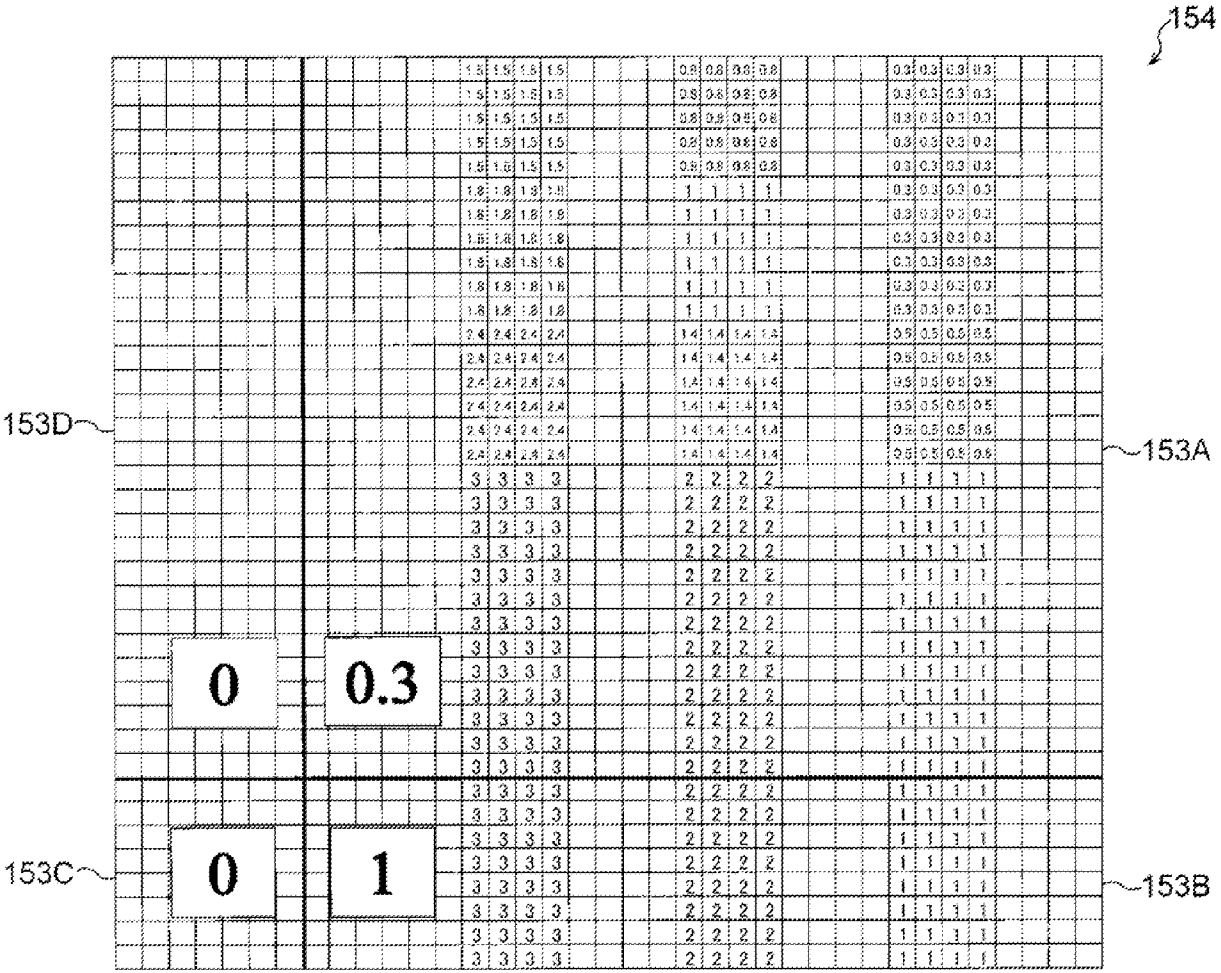
FIG. 19 shows an example of a corrected laser illumination intensity correction coefficient table.

FIG. 19 illustrates an example of the laser illumination intensity correction coefficient table 154 corrected in the processing of step S45. As shown in FIG. 19, the laser illumination intensity correction coefficient of the area 153A is set to 0.3, the laser illumination intensity correction coefficient of the area 153B is set to 1 and the laser illumination intensity correction coefficients of the areas 153C, 153D are set to 0.

Then, in step S55, the control unit 20 corrects the laser illumination intensity data 152 corrected in step S35 by using the laser illumination intensity correction coefficient table 154 corrected in step S45. In the meantime, the method of correcting the corrected laser illumination intensity data 152 is the same as the processing of step S50 in the first illustrative embodiment. That is, the control unit 20 corrects the corrected laser illumination intensity data 152 by multiplying the laser illumination intensity of the laser illumination intensity data 152 corrected in step S35 and the laser illumination intensity correction coefficient of the laser illumination intensity correction coefficient table 154 corrected in step S45, for each pixel.

In this case, since the laser illumination intensity is 1 [J/cm$^2$] in the area 153A before the correction and the laser illumination intensity correction coefficient is 0.3, the illumination intensity of the VCSEL 72' illuminating the area 153A is set to 0.3 [J/cm$^2$] by the multiplication thereof. Likewise, the illumination intensity of the VCSEL 72' illuminating the area 153B is set to 1 [J/cm$^2$] and the illumination intensity of the VCSEL 72' illuminating the areas 153C, 153D is set to 0 [J/cm$^2$].

Like this, according to the inkjet recording apparatus 10 of this illustrative embodiment, the laser illumination intensity and laser illumination intensity correction coefficient of the VCSEL 72' corresponding to the laser illumination range R are set to the smallest values of the laser illumination intensities and laser illumination intensity correction coefficients set for the respective pixels included in the laser illumination range R. Therefore, as compared to a configuration where the smallest values of the laser illumination intensities and laser illumination intensity correction coefficients set for the respective pixels included in the laser illumination range R are not selected, the laser illumination intensity to be illuminated to the printing part is suppressed to be low, so that the discoloring of the printing part is suppressed.

In the meantime, when the user image exists and the printing part not overlapping with the user image exists in the laser illumination range R, like the area 153A, for example, the control unit 20 may be configured to stop the laser illumination from the VCSEL 72' configured to illuminate the corresponding area. For example, the control unit 20 may be configured to set the laser illumination intensity in the area 153A from 1 [J/cm$^2$] to 0 [J/cm$^2$].

In the meantime, since the printing part is not included in the area 153B, the control unit 20 controls the laser driving unit 60 so that the laser is illuminated to the area 153B with the value set by the laser illumination intensity data 152 corrected in the processing of step S55, i.e., 1 [J/cm$^2$]. Also, since the user image is not included in the area 153C and the area 153D, the control unit 20 controls the laser driving unit 60 so that the laser is not illuminated to the area 153C and the area 153D.

In this case, since the laser is not illuminated to the printing part in any area, the discoloring of the printing part is further suppressed, as compared to a configuration where the laser illumination intensity and laser illumination intensity correction coefficient of the VCSEL 72' are set to the smallest values of the laser illumination intensities and laser illumination intensity correction coefficients set for the respective pixels included in the laser illumination range R.

Although the present invention has been described with reference to the illustrative embodiments, the technical scope of the present invention is not limited to the above illustrative embodiments. That is, the above illustrative embodiment can be variously changed or improved without departing from the gist of the present invention, and the changes or improvements are also included in the technical scope of the present invention.

Also, in the above illustrative embodiments, the drying processing is implemented by the software configuration. However, the present invention is not limited thereto. For example, the drying processing may also be implemented by a hardware configuration.

Regarding this, a functional device configured to execute the same processing as the control unit 20 may be prepared and used. In this case, it is expected to execute the processing at higher speed, as compared to the above illustrative embodiments.

Also, in the above illustrative embodiments, the continuous sheet P is used as the recording medium. However, the type of the recording medium is not limited thereto. For example, a cut sheet such as A4 and A3 may also be used. Also, the material of the recording medium is not limited to the sheet. For example, any material to which the ink droplets are fixed by the laser illumination may also be used.

In the meantime, the type of the laser in the above illustrative embodiments is not particularly limited. For example, a VCSEL configured to illuminate UV (Ultra Violet) laser having a wavelength in an ultraviolet region may also be used, in addition to the VCSEL configured to illuminate the infrared laser having a wavelength in an infrared region.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A drying device comprising:

a controller configured to control a laser intensity so that the laser intensity is reduced to be lower than a drying intensity set as an intensity for drying a liquid droplet at a timing when a printing part printed in advance on a recording medium is conveyed into an illumination range of a laser element on an image formation surface of the recording medium and the liquid droplet overlaps the printing part, the controller configured to calculate the timing on the basis of a conveying speed of the recording medium, and the laser element configured to illuminate a laser having the controlled laser intensity to the liquid droplet ejected on the image formation surface of the recording medium in accordance with an image;

wherein the controller is configured to set a value indicating an absorption degree of the laser on the printing part, and the controller controls the laser intensity so that as the value indicating the absorption degree of the laser on the printing part increases, the laser intensity becomes lower, and the controller is configured to set the value indicating the absorption degree of the laser on the printing part by a combination of a color and a density of the printing part and set the drying intensity by a combination of a color of the liquid droplet and an amount of the liquid droplet to be ejected to the image formation surface of the recording medium.

2. The drying device according to claim 1, wherein the controller stops the laser illumination when the liquid droplet is not ejected to overlap with the printing part.

3. The drying device according to claim 1, wherein the controller sets the drying intensity by using intensities of the laser for drying each of a plurality of liquid droplets, which are set for the respective liquid droplets, when the plurality of liquid droplets are ejected into the illumination range of the laser on the image formation surface of the recording medium.

4. The drying device according to claim 3, wherein the controller sets the drying intensity to the lowest intensity of the intensities of the laser for drying the respective liquid droplets, which are set for the respective liquid droplets.

5. The drying device according to claim 3, wherein the controller sets the drying intensity to a weighted average of the intensities of the laser for drying the respective liquid droplets, which are set for the respective liquid droplets.

6. A non-transitory computer readable medium storing a drying program for enabling a computer to function as the controller of the drying device according to claim 1.

7. An image forming apparatus comprising:

an ejector configured to eject a liquid droplet to a recording medium in accordance with an image;

a conveyer configured to convey the recording medium;

the drying device according to claim 1, and a controller configured to control the ejector, the conveyer and the drying device.

* * * * *